US011382474B2

(12) United States Patent
Lubbers

(10) Patent No.: US 11,382,474 B2
(45) Date of Patent: Jul. 12, 2022

(54) BATTERY-OPERATED VACUUM CLEANER

(71) Applicant: KONINKLIJKE PHILIPS N.V., Eindhoven (NL)

(72) Inventor: Matthijs Hendrikus Lubbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 84 days.

(21) Appl. No.: 16/316,809

(22) PCT Filed: Mar. 27, 2018

(86) PCT No.: PCT/EP2018/057795
§ 371 (c)(1),
(2) Date: Jan. 10, 2019

(87) PCT Pub. No.: WO2018/178086
PCT Pub. Date: Oct. 4, 2018

(65) Prior Publication Data

US 2020/0015645 A1 Jan. 16, 2020

(30) Foreign Application Priority Data

Mar. 27, 2017 (EP) ..... 17163173

(51) Int. Cl.
*A47L 9/28* (2006.01)
*A47L 5/24* (2006.01)
*A47L 9/16* (2006.01)

(52) U.S. Cl.
CPC ..... *A47L 9/2884* (2013.01); *A47L 5/24* (2013.01); *A47L 9/16* (2013.01)

(58) Field of Classification Search
CPC ..... A47L 11/00; A47L 11/40; A47L 11/4036; A47L 11/4041; A47L 9/00; A47L 9/24;
(Continued)

(56) References Cited

U.S. PATENT DOCUMENTS

D280,033 S 8/1985 Miyamoto
D290,894 S 7/1987 Miyamoto
(Continued)

FOREIGN PATENT DOCUMENTS

CN 103784081 A 5/2014
CN 104172986 A 12/2014
(Continued)

OTHER PUBLICATIONS

DE-202016104819-U1 translation Espacenet (Year: 2021).*
(Continued)

*Primary Examiner* — Joseph J Hail
*Assistant Examiner* — Timothy Brady
(74) *Attorney, Agent, or Firm* — Schott, P.C.

(57) ABSTRACT

A battery-operated vacuum cleaner comprises a handle (H) having a lower end, a battery (B) having an end that is adjacent to the lower end of the handle (H), a dirt management system (DMS) coupled to an inlet (N) for dirt-loaded air; and an airflow generator (AG) for generating an airflow through the dirt management system (DMS), the airflow generator (AG) being positioned adjacent the battery (B) and a lower end of the handle (H). Preferably, the battery (B) is positioned between the handle (H) and the dirt management system DMS. Advantageously, the battery (B) has a first side adjacent to the airflow generator (AG) and a second side adjacent to the dirt management system (DMS).

15 Claims, 3 Drawing Sheets

(58) Field of Classification Search
CPC . A47L 9/242; A47L 9/246; A47L 5/36; A47L 5/22; A47L 5/12; A47L 7/0014; A47L 9/02; A47L 9/04; A47L 9/068; A47L 9/0686; A47L 9/0693; A47L 9/248; A46B 5/002; A46B 5/0054; A46B 5/0075; A46B 5/0083
USPC ..... 15/347, 250.32, 300.1, 328, 329, 331, 15/334, 354, 359, 414, 415.1
See application file for complete search history.

(56) References Cited

U.S. PATENT DOCUMENTS

| | | | | |
|---|---|---|---|---|
| D303,173 | S | 8/1989 | Isshin | |
| 5,005,252 | A * | 4/1991 | Steiner | A47L 5/24 15/339 |
| 5,025,529 | A * | 6/1991 | Hult | A47L 5/24 15/339 |
| 5,560,076 | A * | 10/1996 | Leung | A47L 5/24 15/339 |
| 7,669,281 | B2 * | 3/2010 | Fukuda | A47L 5/24 15/344 |
| 10,258,208 | B2 * | 4/2019 | Conrad | A47L 9/1666 |
| 10,463,214 | B2 * | 11/2019 | Zhong | A47L 9/2868 |
| 2002/0189048 | A1 * | 12/2002 | Maruyama | A47L 9/1666 15/344 |
| 2006/0021180 | A1 * | 2/2006 | Fukuda | A47L 5/24 15/328 |
| 2007/0022563 | A1 * | 2/2007 | Wu | A47L 5/24 15/344 |
| 2007/0033765 | A1 * | 2/2007 | Walker | A47L 9/2873 15/344 |
| 2009/0241285 | A1 * | 10/2009 | Hinklin | A47L 5/14 15/330 |
| 2010/0192314 | A1 * | 8/2010 | Otsuka | A47L 9/2884 15/3 |
| 2010/0229321 | A1 | 9/2010 | Dyson | |
| 2013/0091657 | A1 | 4/2013 | Smith | |
| 2013/0185892 | A1 | 7/2013 | Walker | |
| 2014/0082882 | A1 * | 3/2014 | Kawamata | A47L 5/24 15/330 |
| 2015/0155606 | A1 * | 6/2015 | Stickney | H01M 50/213 429/90 |
| 2016/0015228 | A1 * | 1/2016 | Conrad | A47L 5/225 15/344 |
| 2016/0015229 | A1 | 1/2016 | Conrad | |
| 2016/0128527 | A1 * | 5/2016 | Grey | A47L 5/24 15/344 |
| 2016/0270615 | A1 | 9/2016 | Kawamura | |
| 2017/0065136 | A1 * | 3/2017 | Latimer | A47L 9/1418 |
| 2017/0209014 | A1 * | 7/2017 | Stickney | A47L 9/242 |

FOREIGN PATENT DOCUMENTS

| | | | | |
|---|---|---|---|---|
| CN | 106343919 | A | 1/2017 | |
| DE | 102008007985 | A1 | 8/2009 | |
| DE | 202015103964 | U1 * | 10/2015 | A47L 5/28 |
| DE | 202016104819 | U1 * | 10/2015 | |
| DE | 202015103964 | U1 * | 12/2017 | |
| DE | 202016104819 | U1 * | 12/2017 | A47L 9/248 |
| JP | 2002085297 | A | 3/2002 | |
| WO | 2014021116 | A1 | 2/2014 | |
| WO | 2015068816 | A1 | 5/2015 | |
| WO | 2016065151 | A1 | 4/2016 | |

OTHER PUBLICATIONS

DE-202015103964-U1 translation Espacenet (Year: 2021).*
American Heritage Dictionary Website—Polygon (Year: 2021).*
Merriam-Webster Website—Adjacent (Year: 2021).*
American Heritage Dictionary Website—Adjacent (Year: 2021).*
Vocabulary.com—adjacent (Year: 2021).*

* cited by examiner

BATTERY-OPERATED VACUUM CLEANER

This application is the U.S. National Phase application under 35 U.S.C. § 371 of International Application No. PCT/EP2018/057795, filed on Mar. 27, 2018, which claims the benefit of European Application No. 17163173.2 filed on Mar. 27, 2017. These applications are hereby incorporated by reference herein.

FIELD OF THE INVENTION

The invention relates to battery-operated vacuum cleaner.

BACKGROUND OF THE INVENTION

US 2010/0229321 discloses hand-held cleaning appliance including an airflow generator for generating an airflow along a suction conduit, a separating apparatus in communication with the suction conduit for separating dirt and dust from the airflow, a power source for supplying power to the airflow generator and a handgrip enabling a user to maneuver the hand-held cleaning appliance. The handgrip has a first end and a second end. The airflow generator is arranged directly adjacent the first end of the handgrip and the power source is arranged adjacent the second end of the handgrip.

WO 2014/02111 discloses a handheld cleaner that has a cleaner body provided with a body housing and a handle. The body housing is internally equipped with an electric motor that uses a battery as a power source. The handle is held by a user. The handle has a first grip and a second grip that are configured to be held while allowing an exchange of hands therebetween. From front to rear, the handheld cleaner features a filter, a fan, a motor, and a battery. The first grip is at some distance behind the battery, and has an upper end connected to the second grip which is above the battery, and a lower end connected to an exhaust pipe which is below the battery, between the fan and a rear end of the handheld cleaner.

US 2016/0015228 discloses a hand carryable surface cleaning apparatus. The apparatus comprises a main body housing a suction motor, and a cyclone bin assembly. The document mentions that the closer the suction motor is to handle, the smaller the moment arm between the handle and the center of gravity of the suction motor. As a result, a user will have to exert less force to maintain surface cleaning apparatus at a desired orientation while in a hand held cleaning mode. Power can be supplied to the surface cleaning apparatus 100 by an electrical cord that can be connected to a standard wall electrical outlet. Alternatively, or in addition, the power source for the surface cleaning apparatus can be an onboard energy storage device, including, for example, one or more batteries.

US 2016/0270615 discloses an electric vacuum cleaner. A battery is housed along the up-down direction at the position of the rear end portion of the case main body, that is, a position on the rear side that is the other lateral side lateral to the axial directions of the turning flows in the first and second centrifugally separating parts.

SUMMARY OF THE INVENTION

It is, inter alia, an object of the invention to provide a battery-operated vacuum cleaner having improved ergonomic properties. The invention is defined by the independent claim 1. Advantageous embodiments are defined in the dependent claims.

One aspect of the invention provides a battery-operated vacuum cleaner comprises a handle having a lower end, a battery having an end that is adjacent to the lower end of the handle, a dirt management system coupled to an inlet for dirt-loaded air; and an airflow generator for generating an airflow through the dirt management system, the airflow generator being positioned adjacent the battery and a lower end of the handle.

Preferably, the battery is positioned between the handle and the dirt management system. Advantageously, the battery has a first side adjacent to the airflow generator and a second side adjacent to the dirt management system.

In embodiments, the three components which are dominant contributors to the overall weight of the appliance are positioned in such a manner that an optimum for ergonomics is generated.

These and other aspects of the invention will be apparent from and elucidated with reference to the embodiments described hereinafter.

DESCRIPTION OF EMBODIMENTS

Figure 1:
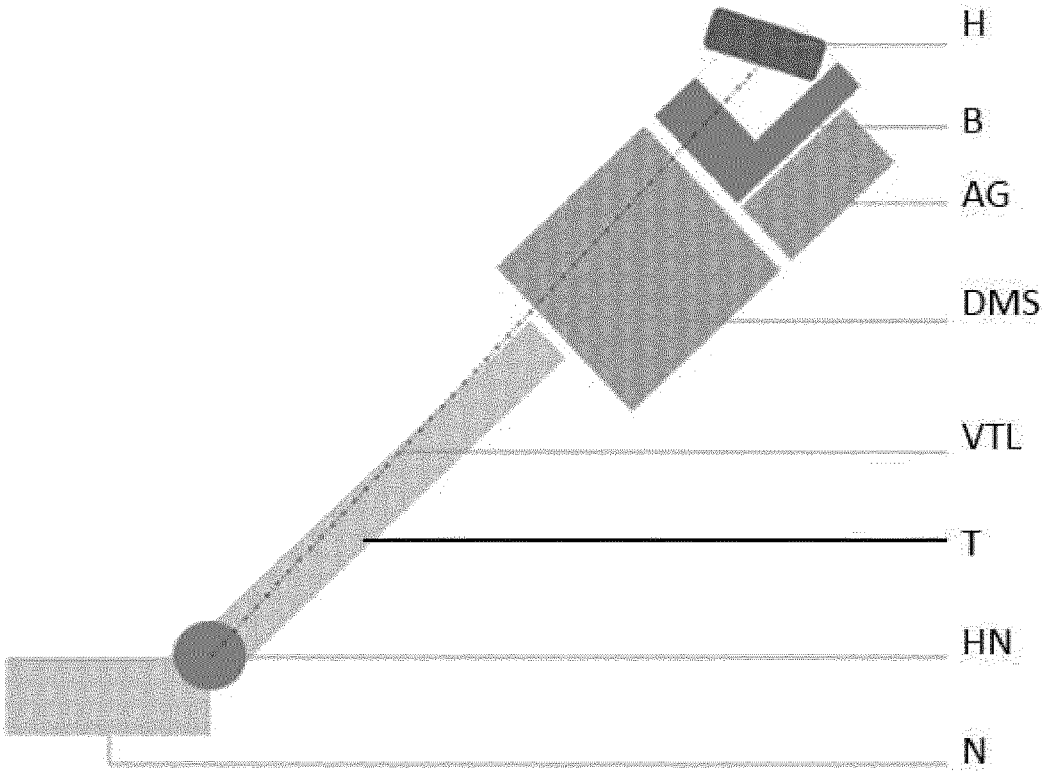
FIGS. 1-12 show various embodiments of a battery-operated vacuum cleaner in accordance with the invention.
Figure 2:
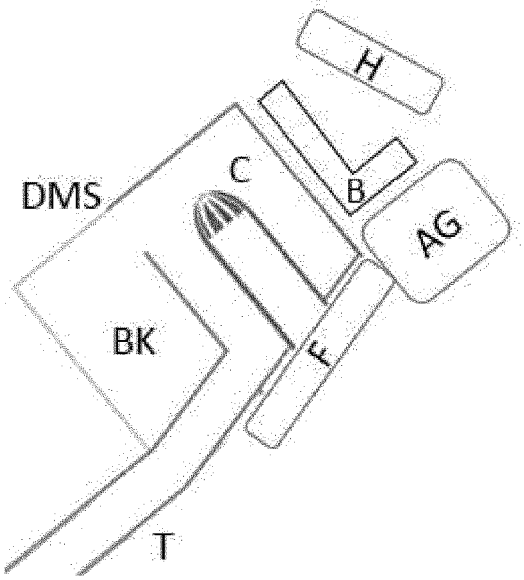

FIGS. 1-12 show various embodiments of a battery-operated vacuum cleaner in accordance with the invention, having a handle H, a power source or battery B, an airflow generator (motor-fan aggregate) AG, a dirt management system (cyclone, bucket, filter) DMS, a suction tube T, a virtual tilting line VTL, a hinge HN and a nozzle N.

A battery-operated vacuum cleaner contains three components which are dominant contributors to the overall weight of the appliance, viz. the airflow generator AG, the dirt management system DMS (which includes a cyclone, a bucket, and a filter) and the most dominant one, the power source formed by the battery B. To solve the high force in the hand during use on surfaces different to the floor, the center of mass should be close to the handle H. To have the optimal position for the center of mass, the three components B, AG, DMS that are dominant contributors to the weight should be arranged in a specific manner.

Most usage of the appliance is vacuuming the floor, this means the center of mass should be close to but in front of the handle. Another important aspect for the position of the center of mass is maneuvering/steering. When the center of mass is above a virtual tilting line VTL (i.e. a virtual line from the hinge HN to a middle of the handle H), the steering becomes very nervous. The mass tilts the appliance to left or right when slightly steered. Having the center of mass exact on to the virtual tilting line VTL is still perceived as nervous. Having the center of mass a bit under the virtual tilting line VTL makes the appliance a bit self-correcting when moving back and forward. This is in general perceived by the user as most comfortable.

The above mentioned position of center of mass determines the position of the heaviest components (dirt management system DMS, airflow generator AG, and battery B) of the appliance. Compared to the power source B and the airflow generator AG, the dirt management system DMS is the biggest component but also not as heavy (low weight/size ratio), and should for that reason be further away from the handle H than the other two components airflow generator AG and the battery B. The airflow generator AG and the battery B should be distributed in front and below the handle H. Another restriction for the airflow generator AG is that the airflow generator AG needs to be connected via an air channel to the dirt management system DMS. To reduce pressure loss, this air channel should be short and wide with a minimum of bends.

The battery B not only serves to provide power for the air flow generator AG but also for several powered accessories such as nozzles and lights. The battery B can be a singular large battery cell or a combination of multiple battery cells to form one power source of sufficient capacity. Due to the power capacity of current state of the art battery cells, several cells are necessary to have a satisfying runtime of the appliance. The advantages of having multiple cells are not only a satisfying runtime, but also that the form of the power source (the combined cells) can be more freely designed. However, it is preferred to have a compact power source which can be replaced easily either by a user or by a service center. Having battery cells on multiple places in the appliance is thus a less preferred option.

Based upon the above mentioned boundaries, an optimal configuration of components can be distilled. The battery B is adjacent to an upper and a lower end of the handle H, where there is sufficient space around the handgrip to position fingers etc. The battery B preferably has an L shape. The airflow generator AG is positioned directly adjacent to the battery B and below the lower end of the handle H. The dirt management system DMS is placed in front of the battery B and the handle H, and is adjacent to the battery B and airflow generator AG. For good ergonomics, the handle H is preferably at an angle of more than 45° with regard to the suction tube T, so that the user can easily push and pull the vacuum cleaner.

Figure 3:
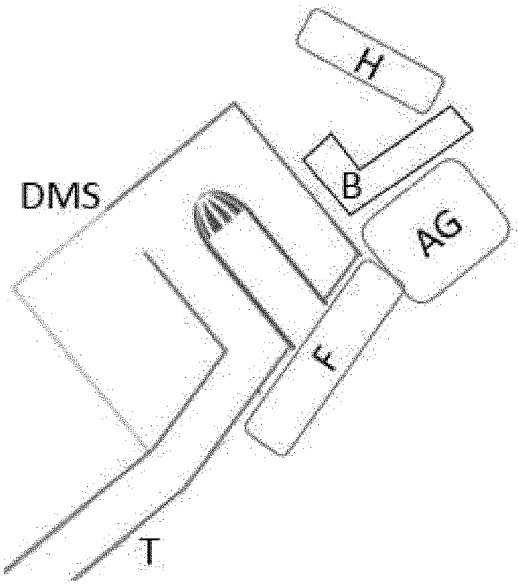
Figure 4:
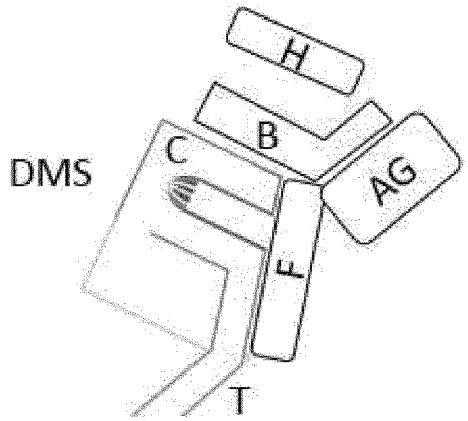
Figure 5:
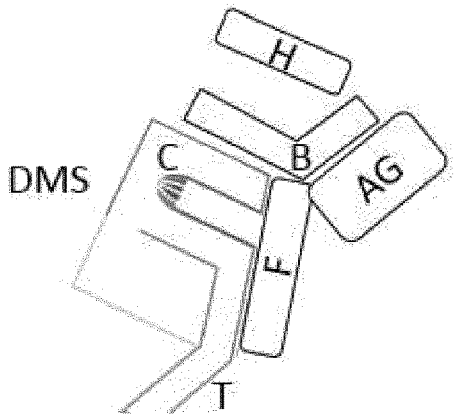
Figure 6:
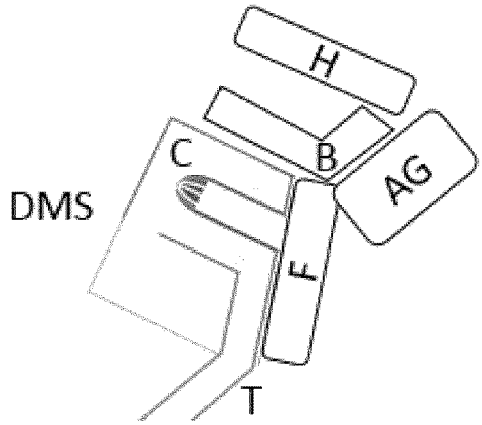
Figure 7:
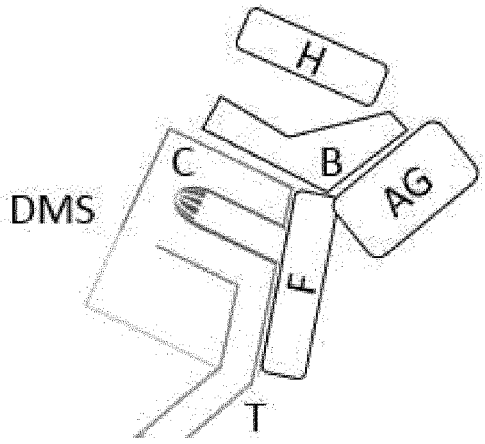
Figure 8:
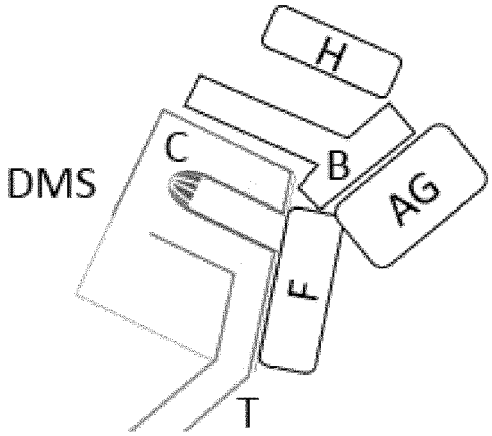
Figure 9:
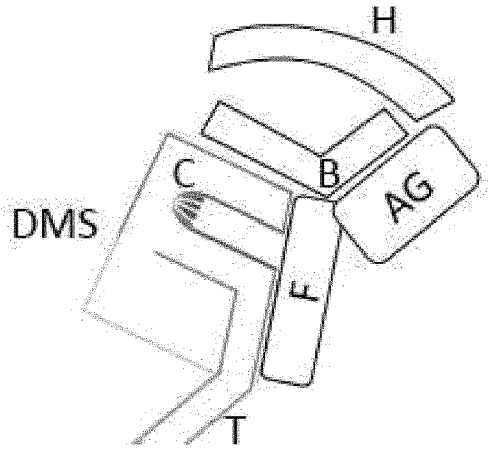
Figure 10:
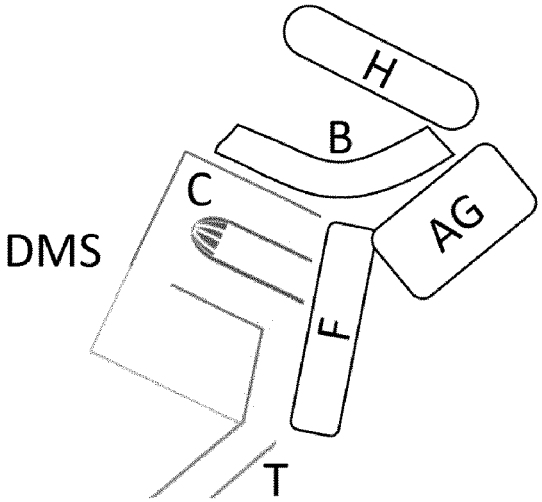
Figure 11:
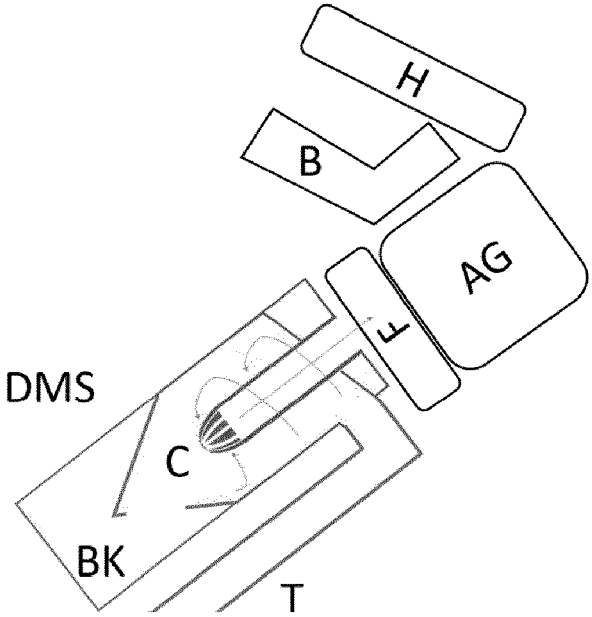
Figure 12:
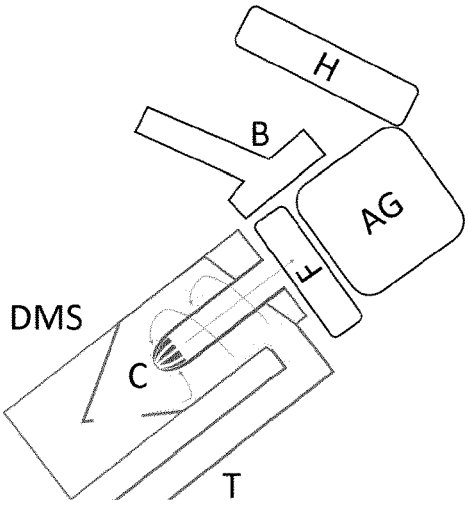

The above principles can be implemented in various ways, of which FIGS. 1-12 show examples. In FIG. 1, the battery B is L shaped, with an approximately 90° angle between the legs of the L, with a relatively thick short leg next to the dirt management system DMS and a relatively thin long leg adjacent to the airflow generator AG. In FIG. 2, the battery B is again L shaped, with an approximately 90° angle between the legs of the L, but now the long leg neighbors the dirt management system DMS (filter F, cyclone C, bucket BK) while the short leg neighbors the airflow generator AG. FIG. 3 resembles FIG. 1, with a slightly differently shaped battery B. FIG. 4 shows a tilted dirt management system DMS, and a battery having two legs neighboring the airflow generator AG and the dirt management system DMS, which two legs are at an angle different from 90°. In FIG. 5, both legs of the battery B have about the same thickness. In FIG. 6, the handle H extends behind the battery B. In a practical embodiment, the shape of battery B resembles \-, i.e. the battery B has a long end neighboring the dirt management system DMS and parallel to but spaced from the handle H, and a short end neighboring the airflow generator AG, in which the long end leans slightly backwards compared to the short end, like in FIGS. 4-6, but different from FIGS. 4-6 in that the long end continues a little downwards beyond the point where the short end connects with the long end. In FIG. 7, the battery B partly has a triangular shape. In FIG. 8, the battery B has a T-shape rather than an L-shape. In FIG. 9, the handle H is curved, the dirt management system DMS is tilted, and the battery B has two legs at an angle larger than 90°. In FIG. 10, the battery B is curved. In FIG. 11, the dirt management system DMS is parallel to the suction tube T, with the cyclone C facing downwards. The battery B is kind of L-shaped, with one leg about parallel to the handle H. In FIG. 12, the dirt management system DMS is again parallel to the suction tube T, with the battery B having a T-shape with the long leg about parallel to the handle H.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A battery-operated vacuum cleaner, comprising:

a handle having an upper end and a lower end;

a battery having a first leg with a first side adjacent to the lower end of the handle;

a dirt management system positioned directly adjacent to a second side, opposite to the first side, of the first leg of the battery, wherein the dirt management system is coupled to an inlet for dirt-loaded air; and an airflow generator for generating an airflow through the dirt management system, the airflow generator being positioned directly adjacent to a first side of a second leg of the battery and below the lower end of the handle, wherein the first leg of the battery is at an angle with the second leg.

2. The battery-operated vacuum cleaner as claimed in claim 1, wherein the battery is positioned between the handle and the dirt management system.

3. The battery-operated vacuum cleaner as claimed claim 1, wherein the handle and at least a part of the battery are spaced apart to allow fingers between the handle and the battery.

4. The battery-operated vacuum cleaner as claimed in claim 1, wherein the battery has a polygon shape, and at least a part of the first leg of the battery is parallel to at least a part of the handle.

5. The battery-operated vacuum cleaner as claimed in claim 1, wherein the second leg of the battery is adjacent to the upper end of the handle.

6. The battery-operated vacuum cleaner as claimed in claim 1, wherein the battery is L-shaped.

7. The battery-operated vacuum cleaner as claimed in claim 1, wherein the dirt management system is positioned in front of the second side of the first leg of the battery and the handle, and wherein the dirt management system is adjacent to the second leg of the battery and the airflow generator.

8. The battery-operated vacuum cleaner as claimed in claim 1, wherein the handle is at an angle of more than 45° with a suction tube coupled to the inlet.

9. The battery-operated vacuum cleaner as claimed in claim 1, wherein the first leg of the battery is thicker and shorter compared to the second leg of the battery.

10. The battery-operated vacuum cleaner as claimed in claim 1, wherein the first leg of the battery is longer compared to the second leg of the battery.

11. The battery-operated vacuum cleaner as claimed in claim 1, wherein the thickness of the first leg is same as the thickness of the second leg.

12. The battery-operated vacuum cleaner as claimed in claim 1, wherein the first side of the first leg is different from the second side of the first leg.

13. The battery-operated vacuum cleaner as claimed in claim 1, wherein the handle extends behind the second leg of the battery.

14. The battery-operated vacuum cleaner as claimed in claim 1, wherein the angle between the first leg and the second leg is greater than 90°.

15. The battery-operated vacuum cleaner as claimed in claim 1, wherein the angle between the first leg and the second leg is 90°.

* * * * *